US009639107B2

(12) United States Patent
Blaauw et al.

(10) Patent No.: US 9,639,107 B2
(45) Date of Patent: May 2, 2017

(54) ULTRA LOW POWER TEMPERATURE INSENSITIVE CURRENT SOURCE WITH LINE AND LOAD REGULATION

(71) Applicant: The Regents of The University of Michigan, Ann Arbor, MI (US)

(72) Inventors: David T. Blaauw, Ann Arbor, MI (US); Dennis Sylvester, Ann Arbor, MI (US); Myungjoon Choi, Ann Arbor, MI (US); Inhee Lee, Ann Arbor, MI (US); Taekwang Jang, Ann Arbor, MI (US)

(73) Assignee: The Regents Of The University Of Michigan, Ann Arbor, MI (US)

( * ) Notice: Subject to any disclaimer, the term of this patent is extended or adjusted under 35 U.S.C. 154(b) by 78 days.

(21) Appl. No.: 14/662,615

(22) Filed: Mar. 19, 2015

(65) Prior Publication Data

US 2015/0268689 A1 Sep. 24, 2015

Related U.S. Application Data

(60) Provisional application No. 61/955,376, filed on Mar. 19, 2014.

(51) Int. Cl.
*G05F 3/16* (2006.01)
*G05F 1/46* (2006.01)
(Continued)

(52) U.S. Cl.
CPC ..... *G05F 3/16* (2013.01); *G05F 1/468* (2013.01); *G05F 1/575* (2013.01); *G05F 3/242* (2013.01)

(58) Field of Classification Search
CPC ..... G05F 3/18; G05F 3/22; G05F 3/30; G05F 3/245; G05F 3/247; G05F 3/262; G05F 3/265; G05F 1/56; H03M 1/00
(Continued)

(56) References Cited

U.S. PATENT DOCUMENTS 6,664,847 B1 * 12/2003 Ye ..... G05F 3/267 323/315
2012/0229102 A1 * 9/2012 Burns ..... H03K 17/102 323/224
2012/0293212 A1 * 11/2012 Hanson ..... G11C 5/147 327/103

FOREIGN PATENT DOCUMENTS

WO WO 2010151754 A2 * 12/2010 ..... G05F 3/242

OTHER PUBLICATIONS

A 1.4-μW 24.9-ppm/° C. Current Reference With Process-Insensitive Temperature Compensation in 0.18-μm CMOS. Junghyup Lee, Member, IEEE, and SeongHwan Cho, Senior Member, IEEE; 10, Oct. 2012.*

(Continued)

*Primary Examiner* — Yemane Mehari
(74) *Attorney, Agent, or Firm* — Harness, Dickey & Pierce, PLC

(57) ABSTRACT

A temperature insensitive sub-nA current reference is presented with pA-range power overhead. The main concept is to linearly reduce the gate voltage of a sub-threshold-biased MOSFET as temperature increases, in order to compensate for exponential dependence of drain current on temperature. For example, a MOSFET-only, 20 pA, 780 ppm/° C. current reference that consumes 23 pW is disclosed, marking the lowest reported power among current references. The circuit exploits sub-threshold-biased MOSFETs and a complementary-to-absolute temperature (CTAT) gate voltage to compensate for temperature dependency. The design shows high immunity to supply voltage of 0.58%/V and a load sensitivity of 0.25%/V.

17 Claims, 8 Drawing Sheets

(51) Int. Cl.
*G05F 1/575* (2006.01)
*G05F 3/24* (2006.01)

(58) Field of Classification Search
USPC ..... 323/311–317
See application file for complete search history.

(56) References Cited

OTHER PUBLICATIONS

PVT Insensitive IREF Generation Suhas Vishwasrao Shinde Mar. 12-14, 2014.*

J. Lee, et al "A 1.4-μW 24.9-ppm/° C. Current Reference With Process-Insensitive Temperature Compensation in 0.18-μm CMOS", IEEE Journal of Solid-State Circuits, vol. 47, No. 10, Oct. 2012.

M. Seok, et al "A Portable 2-Transistor Picowatt Temperature-Compensated Voltage Reference Operating at 0.5 V", IEEE Journal of Solid-State Circuits, vol. 47, No. 10, Oct. 2012.

* cited by examiner

FIG. 9A
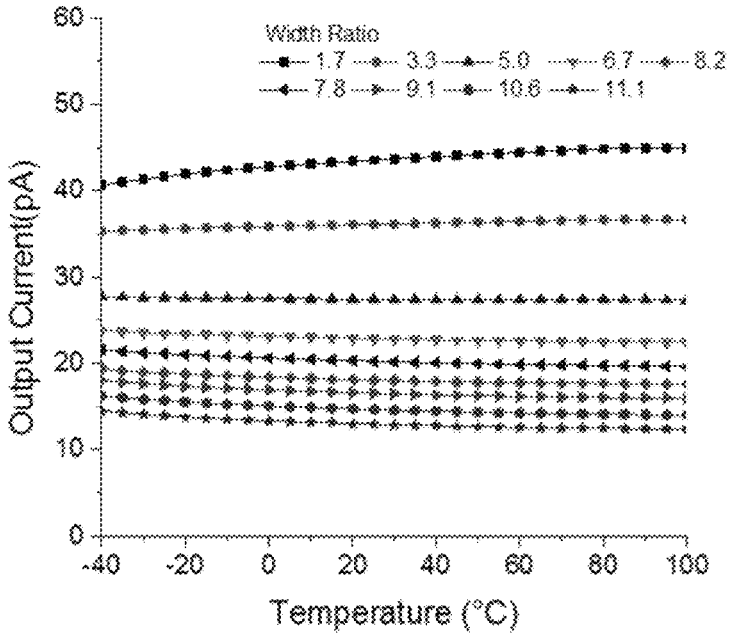
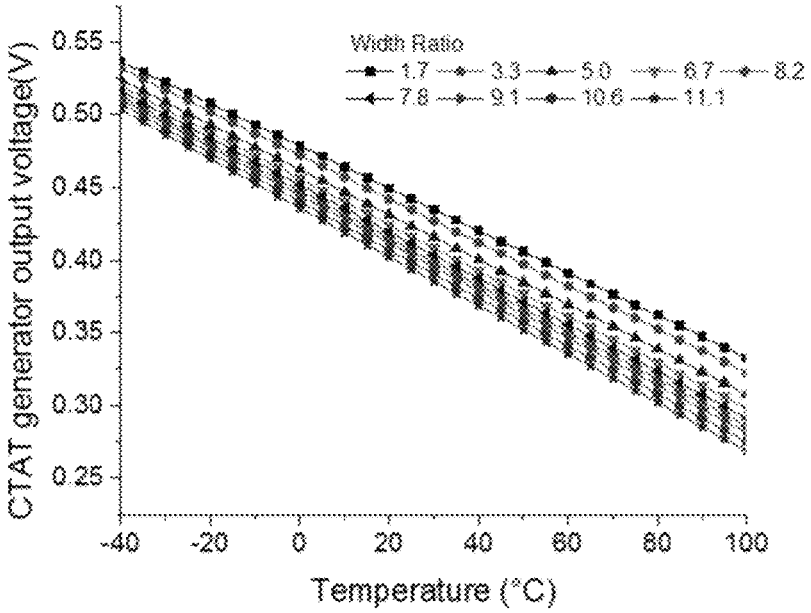
FIG. 9B

ULTRA LOW POWER TEMPERATURE INSENSITIVE CURRENT SOURCE WITH LINE AND LOAD REGULATION

CROSS-REFERENCE TO RELATED APPLICATIONS

This application claims the benefit of U.S. Provisional Application No. 61/955,376 filed on Mar. 19, 2014. The entire disclosure of the above application is incorporated herein by reference.

GOVERNMENT CLAUSE

This invention was made with government support under CNS1111541 awarded by the National Science Foundation. The Government has certain rights in this invention.

FIELD

The present disclosure relates to current reference circuits and more particularly to an ultra-low power temperature insensitive current reference circuit with line and load regulation.

BACKGROUND

Sub-nano ampere current references are of increased interest recently, as micro-scale sensor nodes and bio-implantable systems with limited power budgets gain popularity. These systems use ultra-low-power mixed signal circuits such as oscillators and analog amplifiers, which require current references with low power overhead as key building blocks.

To motivate the need for an ultra-low power current reference with low temperature dependence, consider a recently reported 65 nW CMOS temperature sensor. This sensor uses multiple subthreshold-mode operational amplifiers, each of which consumes 100 s of pA. The amplifiers make up 6% of total analog front-end power consumption at room temperature. However, due to the lack of a temperature-compensated current reference, amplifier power increases exponentially with temperature such that they consume 52% of total analog front end power at 100° C. Adopting the current reference circuit proposed in this disclosure would limit the amplifier and current reference overhead power to only 6% at 100° C., reducing total analog front-end power from 56.2 nW to 14.9 nW at 100° C.

Many conventional current reference circuits are variations of the β-multiplier reference shown in FIG. 1A. However, this type of reference is unsuitable for the sub-nA current generation as it requires an extremely large resistor of 1 GΩ or more. Further, a start-up circuit is needed to prevent the circuit from becoming trapped in an undesired operating point, adding area overhead. One known technique replaces the resistor with a MOSFET to create a subthreshold version of the β-multiplier, however the circuit remains in the nW range (88 nW@1.3V).

With reference to FIG. 1B, other proposed current references employ a reference voltage and a resistor, achieving a temperature coefficient (TC) as low as 24.9 ppm/° C. However, those circuits consume μW's and their use of resistors complicate sub-nA current generation. Also, polysilicon resistors vary by up to ±25%; this variability is independent of transistor process variation, potentially worsening process sensitivity.

This disclosure proposes a new topology to generate a sub-nA (20 pA) level reference current with very low power overhead. It shows 780 ppm/° C. TC and consumes 23 pW, which is more than fifty times smaller than the lowest power consumption reported previously. This disclosure also describes techniques to improve supply voltage regulation and load voltage regulation.

This section provides background information related to the present disclosure which is not necessarily prior art.

SUMMARY

This section provides a general summary of the disclosure, and is not a comprehensive disclosure of its full scope or all of its features.

A low power temperature insensitive current reference is provided. The current reference is comprised of a voltage regulator, a complementary-to-absolute temperature (CTAT) voltage generator, and an output stage. The voltage regulator is configured to receive a supply voltage and operates to output a constant regulated voltage. The output stage includes at least one output transistor configured to produce a reference current. The CTAT voltage generator is configured to receive the regulated voltage from the voltage regulator and supply a gate voltage to a gate terminal of the output transistor in the output stage. The CTAT voltage generator adjusts the gate voltage linearly and inversely with changes in temperature.

In some embodiments, the voltage regulator, the CTAT voltage generator and/or the output stage are comprised of transistors operating only in the subthreshold region.

The output stage may further include a buffer transistor in a cascode arrangement with the output transistor.

Further areas of applicability will become apparent from the description provided herein. The description and specific examples in this summary are intended for purposes of illustration only and are not intended to limit the scope of the present disclosure.

BRIEF DESCRIPTION OF THE DRAWINGS

The present disclosure will become more fully understood from the detailed description and the accompanying drawings, wherein:

FIGS. 9A and 9B are graphs showing simulation results of the output current and output voltage, respectively, from the CTAT voltage generator across different ratios of PMOS widths;

Figure 1A:
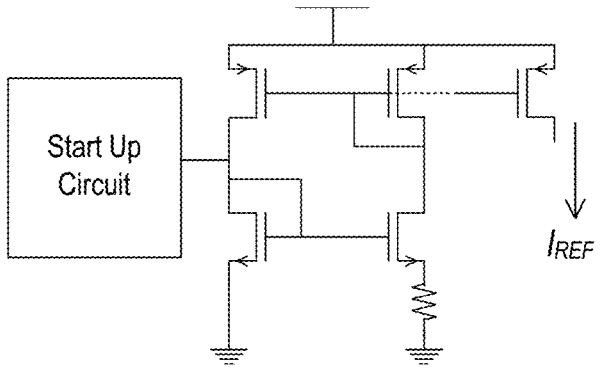
FIG. 1A is a schematic of a conventional current reference based on a β-multiplier.
Figure 1B:
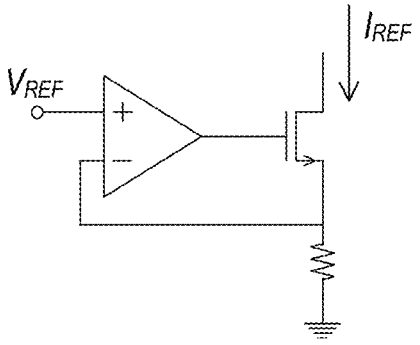
FIG. 1B is a schematic of a conventional current reference employing a voltage reference divided by a resistor.

The drawings described herein are for illustrative purposes only of selected embodiments and not all possible implementations, and are not intended to limit the scope of the present disclosure. Corresponding reference numerals indicate corresponding parts throughout the several views of the drawings.

DETAILED DESCRIPTION

Figure 2:
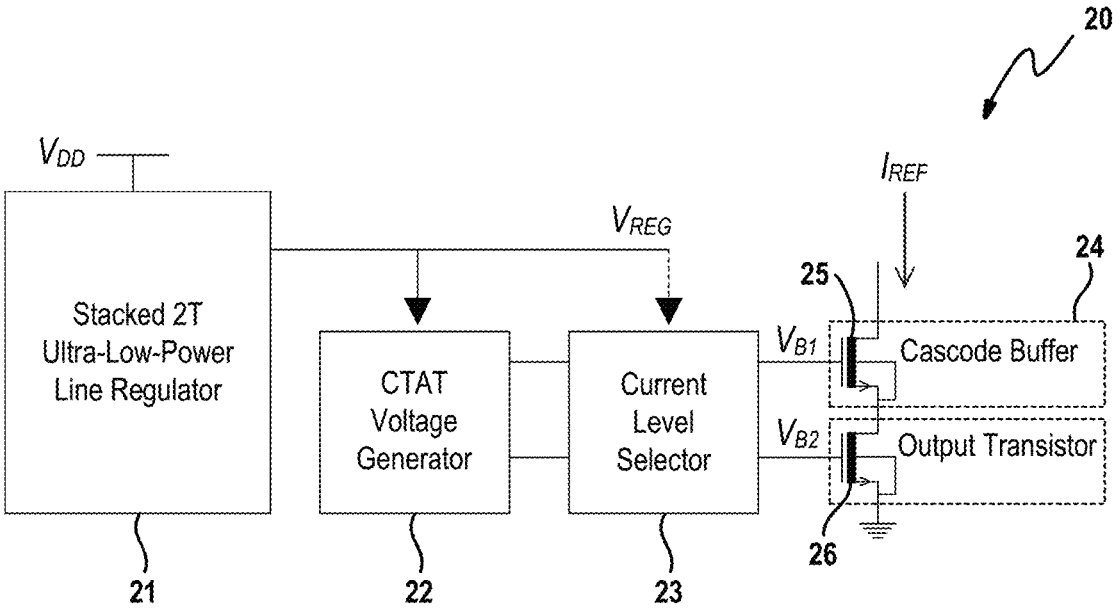
FIG. 2 is a block diagram of a current reference according to the present disclosure.

FIG. 2 depicts a proposed current reference 20. The basic idea of this disclosure is to linearly reduce the gate voltage of a subthreshold-biased MOSFET as temperature increases, providing compensation (first order) for the exponential dependence of drain current on temperature. The design challenge is to achieve this with pW-level power overhead. The proposed design has three primary components: an ultra-low power line regulator 21, a complementary-to-absolute temperature (CTAT) voltage generator 22 and an output stage 24. An optional current level selector circuit 23 can be incorporated to provide a tunable range of current magnitudes.

The power line regulator 21 is configured to receive a supply voltage $V_{DD}$ and operates to output a regulated voltage (i.e., a voltage having a constant level) $V_{REG}$. To achieve low power, the power line regulator is preferably comprised of transistors operating only in the subthreshold region. It is envisioned that the power line regulator 21 may be implemented by a variety of known voltage regulating circuits.

The output stage 24 is comprised of at least one output transistor 26. In one embodiment, the drain terminal of the output transistor 26 is configured to produce a reference current. The output stage 24 may also include a buffer transistor 25 in a cascode arrangement with the output transistor 26. The buffer transistor 25 and the output transistor 26 preferably operate only in a subthreshold region. Other variants for the output stage are contemplated by this disclosure; some of which are further described below.

The CTAT voltage generator 22 is used to compensate for the temperature dependence of the threshold voltage of the transistors in the output stage 24. The CTAT voltage generator 22 is configured to receive the regulated voltage from the voltage regulator 21 and biases on the transistors comprising the output stage 24, such that the transistors are biased to operate only in the subthreshold region. More specifically, the CTAT voltage generator 22 supplies a gate voltage to the gate terminals of the transistors in the output stage 24, where the gate voltages are adjusted linearly and inversely with changes in temperature.

Figure 3:
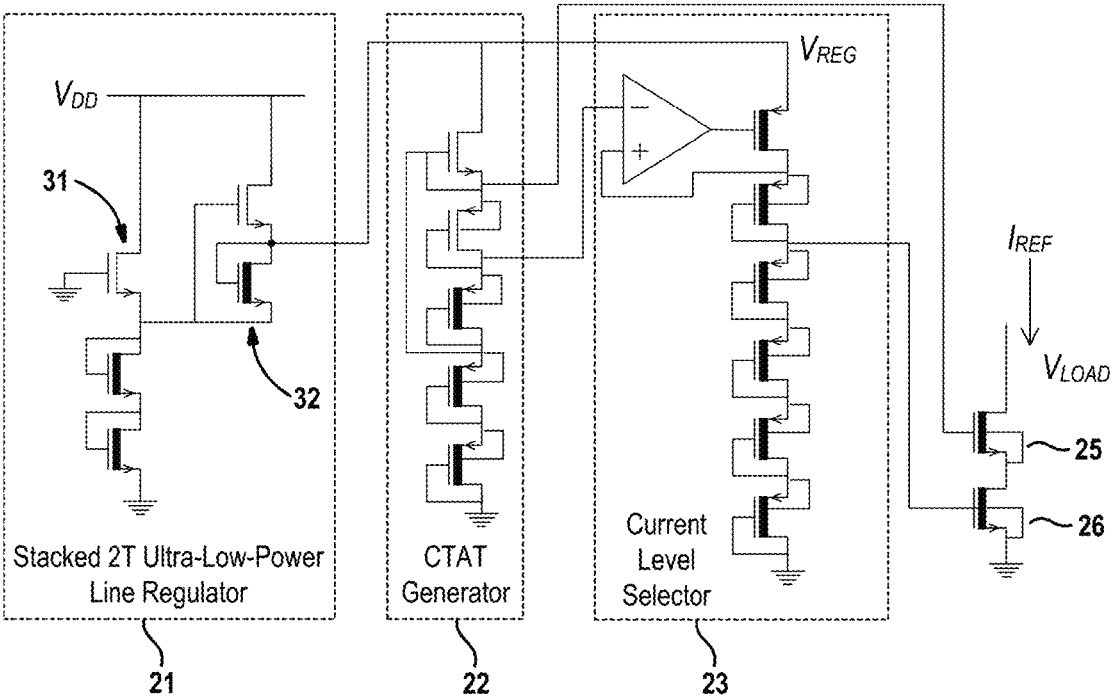
FIG. 3 is a schematic of an example embodiment of the current reference.

FIG. 3 is a schematic of an example embodiment of the proposed current reference 30. In the example embodiment, the line regulator 21 is implemented by two voltage reference circuits whose voltages are added together. More specifically, the line regulator 21 includes a first voltage reference 31 (on right) comprised of a two-stacked 2 T voltage reference and a second voltage reference 32 (on left) comprised of stacked 3 T voltage reference. An output node for the reference voltage from the second voltage reference 32 is coupled to the gate terminal of the upper transistor in the first voltage reference 31 and coupled to the source terminal of the lower transistor in the first voltage reference 31. As a result, the reference voltage output by the line regulator 21 is the sum of the reference voltage from the first voltage reference 31 and the reference voltage from the second voltage reference 32. Further information for the two-stacked 2 T arrangement can be found in "A Portable 2-Transistor Picowatt Temperature-Compensated Voltage Reference Operating at 0.5 V" by Mingoo et al. in IEEE Journal of Solid-State Circuits, vol. 47, no. 10, October 2012. Moreover, other circuit arrangements for the line regulator also contemplated by this disclosure.

Figure 5A:
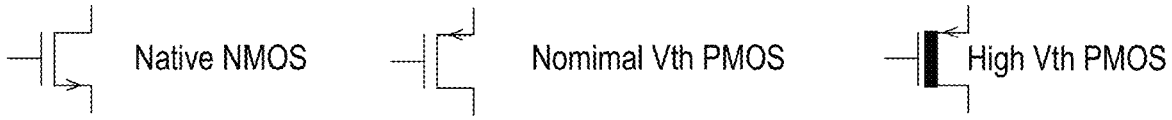
FIGS. 5A-5C are schematics of example embodiments for the CTAT voltage generator.
Figure 5A:
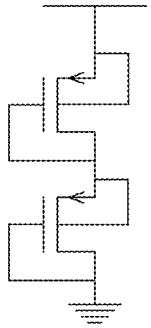
Figure 5B:
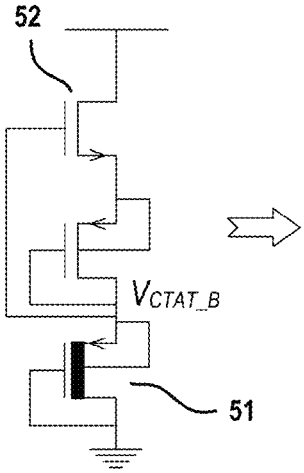
Figure 5C:
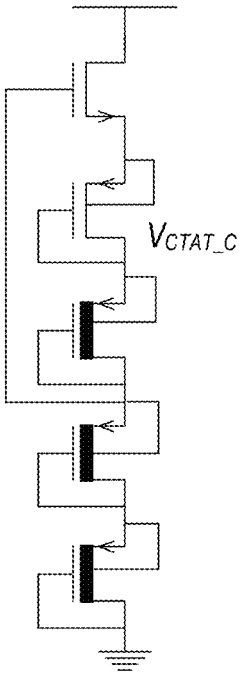

To achieve lower supply sensitivity, the desired temperature coefficient and reduced power, a conventional CTAT generator may be modified as described in relation to FIGS. 5A-5C. In one embodiment, the CTAT voltage generator 22 may be implemented by a conventional circuit arrangement as shown in FIG. 5A. That is, the CTAT voltage generator 22 is implemented by a stack of two diode-connected transistors.

Figure 6:
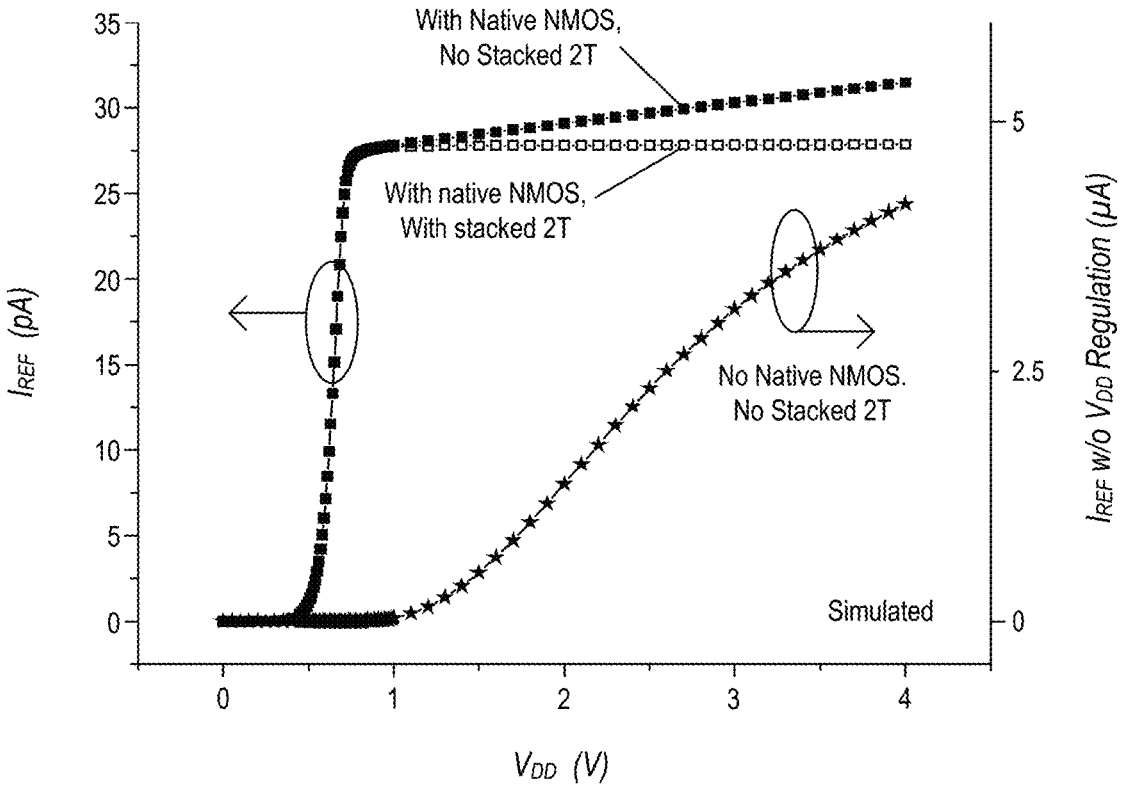
FIG. 6 is a graph depicting the output current for the different embodiments of the CTAT voltage generator in FIGS. 5A-5C.

In FIG. 5B, a native NMOS 52 is added to the top of the stack and the threshold voltage is increased for the PMOS 51 on the bottom of the stack. As a result, the transistors in the stack of diode-connected transistors may have different channel lengths. In this example, the high-Vth device 51 minimizes power consumption while the native NMOS 52 added at the top of the stack reduces supply sensitivity from 4.42%/V to 4.39%/V. It is also noted that the second voltage reference 32 in the line regulator 21 serves as an additional supply rejection stage, thereby further decreasing supply voltage sensitivity by a factor of 36× as seen in FIG. 6.

Figure 7:
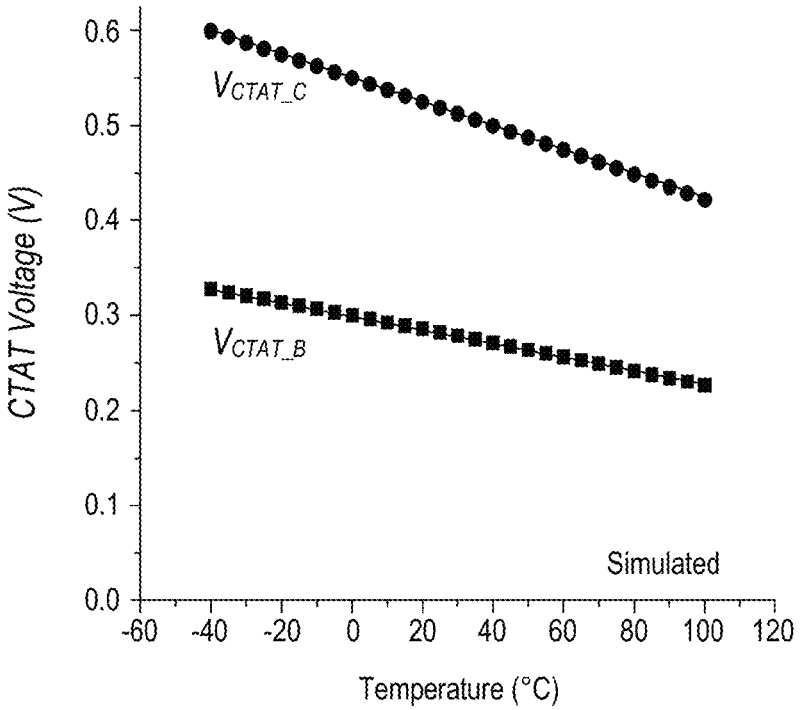
FIG. 7 is a graph depicting CTAT voltage generated by the diode-connected stack shown in FIG. 5C.

In another example arrangement, two additional PMOS transistors are added to the bottom of the stack as seen in FIG. 5C. In this arrangement, the stack of diode-connected transistors includes an n-channel MOSFET followed by four p-channel MOSFETs, where the drain terminal of the n-channel MOSFET is configured to receive the regulated voltage from the line regulator 21. These two transistors increase the temperature coefficient to the required value, from −0.72 mV/° C. to −1.26 mV/° C. as seen in FIG. 7. FIG. 9 shows that $V_{CTAT\text{-}C}$ slope and temperature coefficient of the output current can be controlled by changing transistor width ratio of nominal-Vth PMOS and high-Vth PMOS in the CTAT generator 22. It is understood that these examples are not limiting and similar variations may be made to the circuit arrangement for the CTAT generator 22.

A level selector circuit 23 is interposed between the CTAT voltage generator 22 and the output stage 24. The level selector circuit 23 is also implemented by a stack of diode-connected transistors. While only a single output node is shown for the level selector in FIG. 3, it is understood that one or more output nodes may be disposed between transistors in the stack to obtain gate voltages having different magnitudes. The level selector 23 may be further configured so that the different gate voltages are selectively coupled to the output stage.

In the output stage 24, the threshold voltages of the output transistors vary across process corners, resulting in considerable change in the reference current. This is mitigated by using different device types and channel lengths in the CTAT voltage generator 22, such that the voltage levels of $V_{B1}$ and $V_{B2}$ track that of the threshold voltage of output stage transistors. Short-channel and high-Vth devices are used for the lower three transistors, while long-channel and nominal-Vth devices are used for the upper transistor in the CTAT generator 22 (e.g., see FIG. 5C). This results in a correlation coefficient of 0.9983 between gate voltages $V_{B1}$, $V_{B2}$, applied to the transistors in the output stage and the threshold voltage of output stage transistors in global corner simulation. In other words, the magnitude of the gate voltages is substantially equal to the threshold voltage of the output stage transistors.

Figure 8:
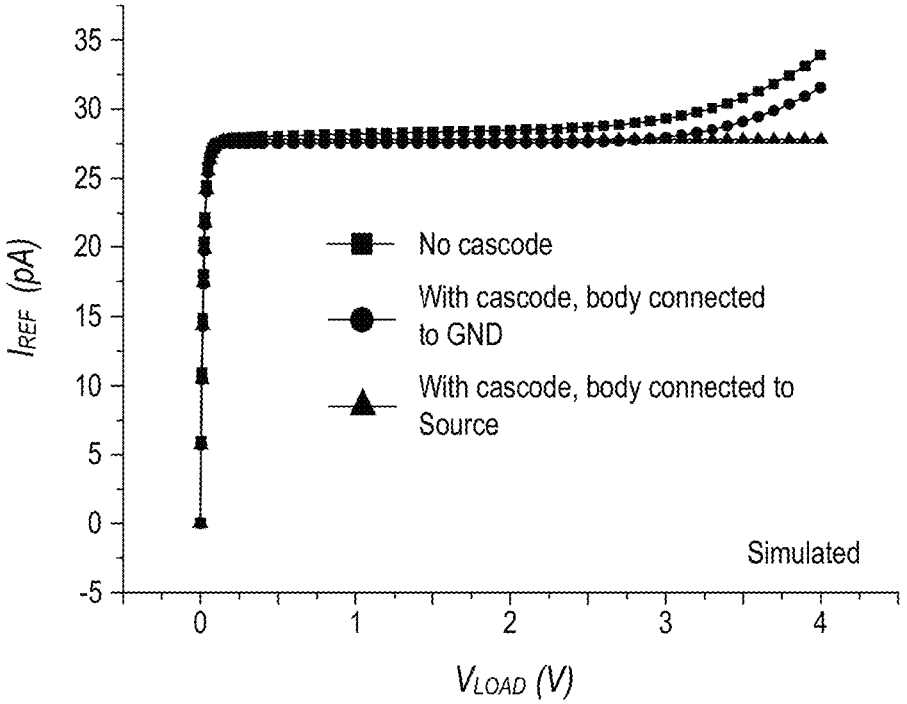
FIG. 8 is a graph illustrating load sensitivity of output current using the different embodiments for the output stage in FIGS. 10A-10C.
Figures 10A, 10B, 10C:
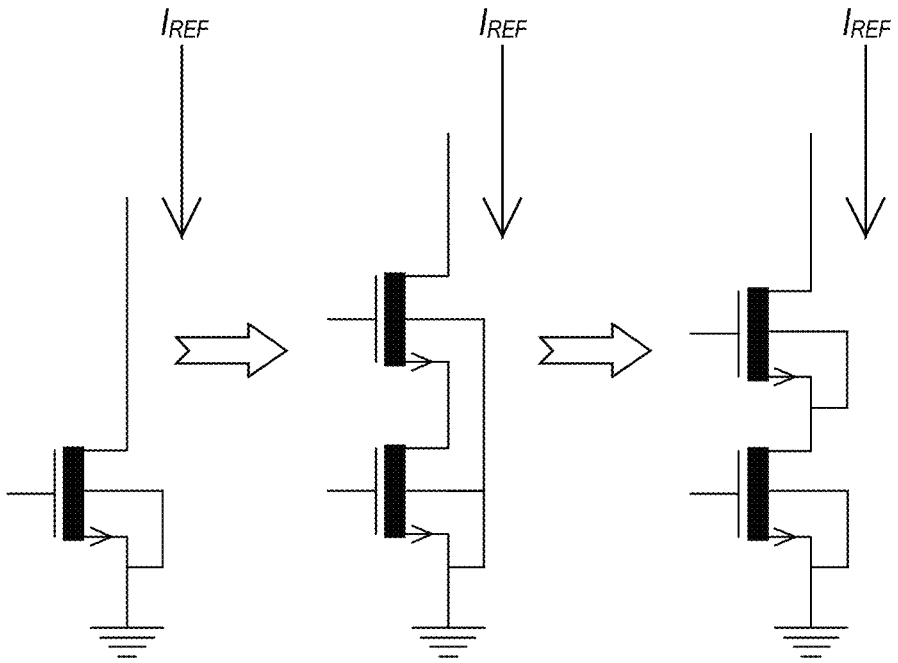
FIGS. 10A-10C are schematics of example embodiments for the output stage.

For the output stage, the drain current of a MOSFET operating in the subthreshold regime is nearly independent of $V_{DS}$ as long as it exceeds 3-4 kT/q. Drain-induced barrier lowering (DIBL), however, increases load sensitivity to 4.83%/V (simulation). To address this, a cascode stack on the output transistor 26 is used to buffer the drain voltage of the output transistor as seen in FIG. 10B, thereby reducing load sensitivity to 3.48%/V. To further reduce load sensitivity, the cascode MOSFET body is tied to its own source to prevent substrate current induced body effect as shown in FIG. 10C. This yields a load sensitivity of 0.35%/V from 0.1V to 4V as simulated and shown in FIG. 8.

With continued reference to the example embodiment shown in FIG. 3, the output current of the proposed current reference 30 can be derived as (1), below. Since the subthreshold current exponentially depends on both absolute temperature and gate to source voltage, by linearly decreasing the MOSFET gate voltage as temperature increases (Equation 2), transistor drain current remains nearly constant. Equation (3) shows that the remaining temperature dependent terms are T^(½) and exp($a_2$/T), which approximately cancel out each other with respect to T. To simplify, temperature independent terms are packed into a $a_1$ and $a_2$. Differentiating (1) with respect to T gives (5). Setting it to 0 provides the temperature where the output current is temperature-independent as derived in (6). If we want to operate this circuit to be temperature-independent at room temperature ($T_r$), the gate voltage can be designed so that $V_{gs0}$ of (7) is met. The following B section describes how to generate this gate voltage.

$$I_{REF} = \mu(T_r)\left(\frac{T}{T_r}\right)^{-1.5} C_{ox}\frac{W}{L}\left(\frac{kT}{q}\right)^2 e^{\left(\frac{q(V_{gs}-V_{th0}+k_{V_{th}}T)}{mkT}\right)} \tag{1}$$

$$V_{gs} = V_{gs0} - k_{V_{gs}}T \tag{2}$$

$$I_{REF} = a_1 T^{\frac{1}{2}} e^{\frac{a_2}{T}} \tag{3}$$

$$a_1 = \mu(T_r)C_{ox}\frac{w}{T_r^{-1.5}}\frac{k^2}{q^2}e^{\frac{q(k_{V_{th}}-k_{V_{gs}})}{mk}},\ a_2 = \frac{q(V_{gs0}-V_{th0})}{mk} \tag{4}$$

$$\frac{\partial I_{REF}}{\partial T} = a_1 e^{\frac{a_2}{T}} T^{-\frac{1}{2}}\left(\frac{1}{2} - a_2 T^{-1}\right) = 0 \tag{5}$$

$$T\left(\frac{\partial I_{REF}}{\partial T} = 0\right) = 2a_2 = \frac{2q(V_{gs0}-V_{th0})}{mk} \tag{6}$$

$$V_{gs0} = \frac{mkT_r}{2q} + V_{th0} \tag{7}$$

where μ is mobility, $C_{ox}$ is oxide capacitance, and W and L are MOSFET width and length. $V_{gs0}$ is $V_{gs}$ at 0K and $V_{th0}$ is threshold voltage at 0K. $k_{V_{th}}$ and $k_{V_{gs}}$ are temperature coefficients.

Figure 4:
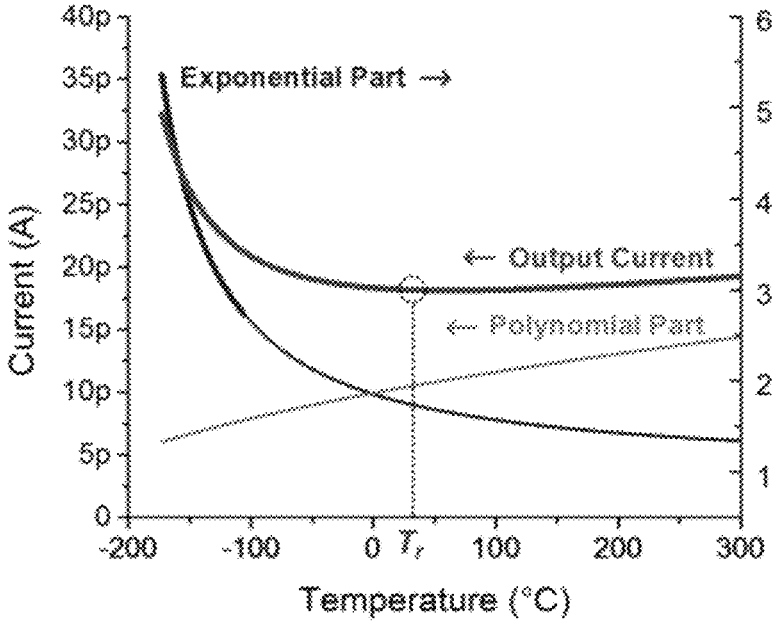
FIG. 4 is a graph showing simulation results of the current reference in FIG. 3.

To validate this analysis, MATLAB simulation results with the above model are plotted in FIG. 4. The exp($a_2$/T) part decreases while the T^(½) part increases across the temperature. As they cancel each other, the output current shows nearly constant behavior for the desired range centered at $T_r$.

Figure 11:
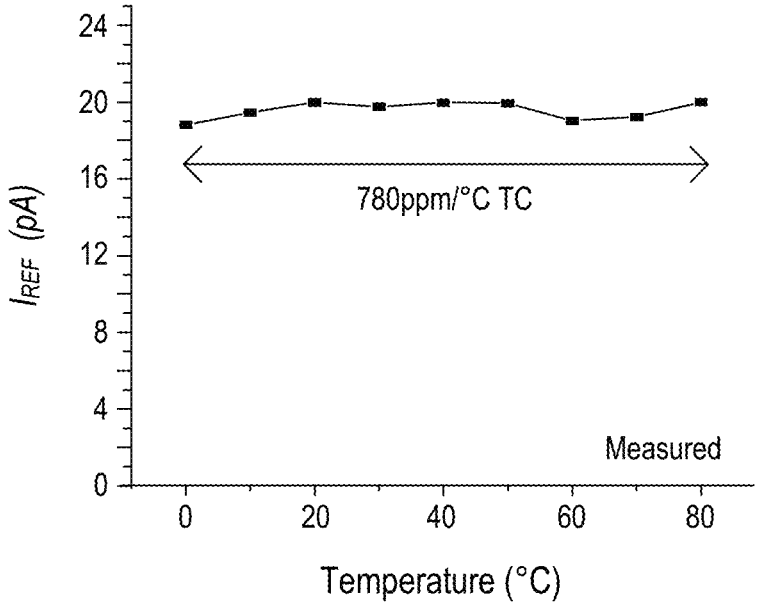
FIG. 11 is a graph depicting the current reference across temperature.
Figure 12:
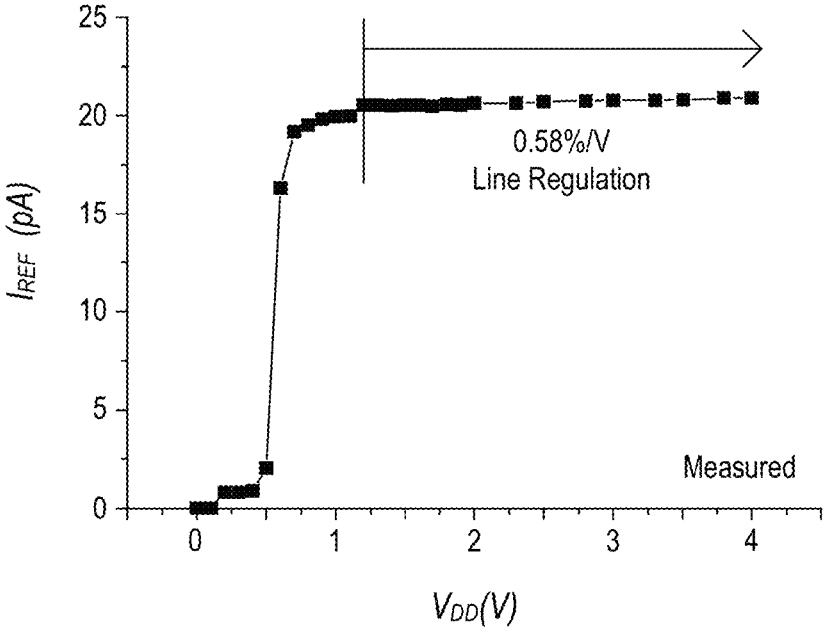
FIG. 12 is a graph depicting the sensitivity of the reference current across different supply voltages.
Figure 13:
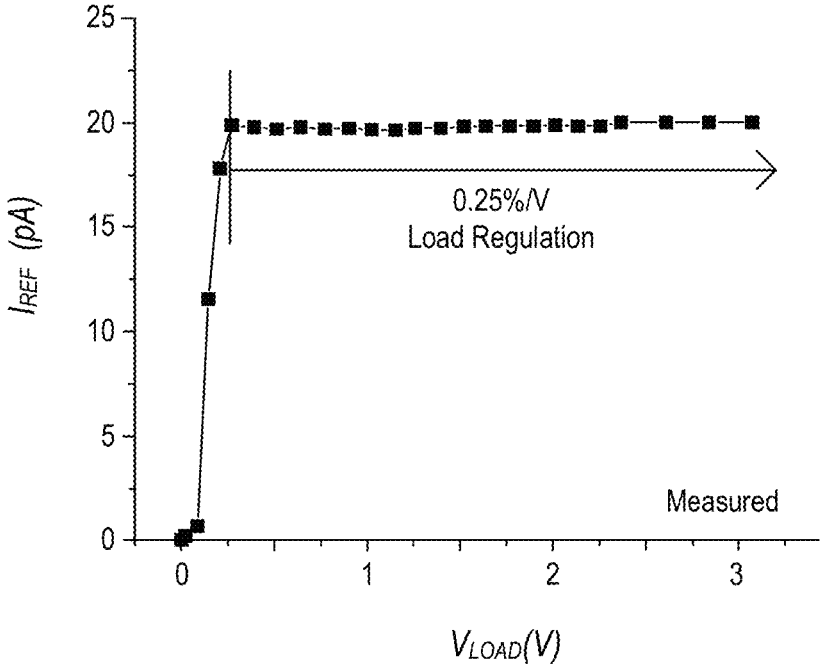
FIG. 13 is a graph depicting sensitivity of the reference current across different loads.

FIG. 11 shows the measured output current across temperature, which maintains its desired level within 780 ppm/° C. to 80° C. FIG. 12 shows measured line sensitivity of 0.58%/V for $V_{DD}$ ranging from 1.2V to 4V. Load sensitivity measurement results are shown in FIG. 13, showing load sensitivity of 0.25%/V for $V_{LOAD}$ between 0.27V and 3 V.

The description of the embodiments herein has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A current reference circuit, comprising:

a voltage regulator configured to receive a supply voltage and output a constant regulated voltage, the voltage regulator comprised of transistors operating only in the subthreshold region;

an output stage having an output transistor, wherein the output transistor has a drain terminal configured to produce a reference current and is operating only in a subthreshold region; and a complementary-to-absolute temperature (CTAT) voltage generator configured to receive the regulated voltage from the voltage regulator and supply a gate voltage to a gate terminal of the output transistor, where the CTAT voltage generator is comprised of transistors operating only in the subthreshold region and the CTAT voltage generator adjusts the gate voltage linearly and inversely with changes in temperature.

2. The current source of claim 1 wherein the CTAT voltage generator is implemented by a stack of diode-connected transistors.

3. The current source of claim 2 wherein a transistor at top of the stack of diode-connected transistors has a different doping type than remainder of the transistors in the stack of diode-connected transistors.

4. The current source of claim 2 wherein one or more transistors on bottom of the stack of diode-connected transistors have a larger threshold voltage than remainder of transistors in the stack of diode-connected transistors.

5. The current source of claim 1 wherein magnitude of the gate voltage is substantially equal to threshold voltage of the output transistor.

6. The current source of claim 1 wherein the output stage further comprises a buffer transistor having a cascode arrangement with the output transistor.

7. The current source of claim 6 wherein the CTAT voltage generator supplies a gate voltage to a gate terminal of the buffer transistor and adjusts the gate voltage linearly and inversely with changes in temperature.

8. The current source of claim 6 wherein body of the buffer transistor is electrically coupled to a source terminal of the buffer transistor and body of the output transistor is electrically coupled to a source terminal of the output transistor.

9. The current source of claim 1 further comprises a level selector circuit electrically coupled between the CTAT voltage generator and the output stage.

10. A current source, comprising:

a voltage regulator circuit configured to receive a supply voltage and output a constant regulated voltage, the voltage regulator comprised of transistors operating only in the subthreshold region;

an output stage configured to produce a reference current, wherein the output stage includes a first metal-oxide semiconductor field-effect transistor (MOSFET) and a second MOSFET coupled together in a cascode arrangement; and a complementary-to-absolute temperature (CTAT) voltage generator configured to receive the regulated voltage from the voltage regulator and biases the first MOSFET and the second MOSFET to operate only in the subthreshold range, where bias voltages for the first and second MOSFETs are adjusted linearly and inversely by the CTAT voltage generator with changes in temperature.

11. The current source of claim 10 wherein the CTAT voltage generator is comprised of transistors operating only in the subthreshold region.

12. The current source of claim 10 wherein the CTAT voltage generator is implemented by a stack of diode-connected transistors.

13. The current source of claim 12 wherein a transistor at top of the stack of diode-connected transistors is configured to reduce sensitivity to variations in the supply voltage.

14. The current source of claim 12 wherein one or more transistors on bottom of the stack of diode-connected transistors are configured to minimize power consumption.

15. The current source of claim 10 wherein the CTAT voltage generator supplies a gate voltage to a gate terminal of both the first MOSFET and the second MOSFET, such that the magnitude of the gate voltages are substantially equal to threshold voltage of the second MOSFET.

16. The current source of claim 10 wherein body of the first MOSFET is electrically coupled to a source terminal of the first MOSFET and body of the second MOSFET is electrically coupled to a source terminal of the second MOSFET.

17. The current source of claim 10 further comprises a level selector circuit electrically coupled between the CTAT voltage generator and the output stage.

* * * * *